US010642186B2

(12) United States Patent
Sakurai et al.

(10) Patent No.: US 10,642,186 B2
(45) Date of Patent: May 5, 2020

(54) DEVELOPING MEMBER HAVING OUTER SURFACE WITH INDEPENDENT ELECTRICALLY INSULATING DOMAINS, ELECTROPHOTOGRAPHIC PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Yuji Sakurai, Susono (JP); Minoru Nakamura, Mishima (JP); Ryo Sugiyama, Mishima (JP); Kazutoshi Ishida, Mishima (JP); Hiroshi Morishita, Tsukuba (JP); Kenta Matsunaga, Susono (JP); Kentarou Nakamura, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/280,201

(22) Filed: Feb. 20, 2019

(65) Prior Publication Data

US 2019/0265609 A1 Aug. 29, 2019

(30) Foreign Application Priority Data

Feb. 26, 2018 (JP) ..... 2018-032436

(51) Int. Cl.
*G03G 15/08* (2006.01)

(52) U.S. Cl.
CPC ..... *G03G 15/0808* (2013.01); *G03G 15/0818* (2013.01); *G03G 2215/0861* (2013.01)

(58) Field of Classification Search
CPC ..... G03G 15/0808; G03G 15/0818; G03G 15/1685; G03G 21/1814; G03G 2215/0858; G03G 2215/0861
See application file for complete search history.

(56) References Cited

U.S. PATENT DOCUMENTS 4,558,943 A * 12/1985 Patz ..... G03G 15/0812 399/274
4,696,255 A * 9/1987 Yano ..... G03G 15/0818 399/281

(Continued)

FOREIGN PATENT DOCUMENTS

JP H06-130792 A 5/1994
JP 07160113 A * 6/1995

(Continued)

*Primary Examiner* — David M. Gray
*Assistant Examiner* — Laura Roth
(74) *Attorney, Agent, or Firm* — Venable LLP

(57) ABSTRACT

The developing member includes a substrate, and an electroconductive layer on the substrate, wherein the electroconductive layer has electrically insulating domains on an outer surface thereof, the domains being independent from each other, the developing member has an outer surface including a surface of the electroconductive layer and surfaces of the domains, and wherein, when each of the domains is orthographically projected onto the surface of the electroconductive layer, defining respective areas of projected images of the domains as S, and defining respective areas of convex envelopes of the projected images as H, at least one domain satisfies the relation represented by $0.05 \leq S/H \leq 0.80$.

18 Claims, 7 Drawing Sheets

(56) References Cited

U.S. PATENT DOCUMENTS

| | | | | |
|---|---|---|---|---|
| 6,725,002 | B2 | 4/2004 | Sakurai et al. | |
| 7,201,967 | B2 | 4/2007 | Sakurai et al. | |
| 7,727,134 | B2 | 6/2010 | Nakamura et al. | |
| 7,797,833 | B2 | 9/2010 | Nakamura et al. | |
| 7,798,948 | B2 | 9/2010 | Kawamura et al. | |
| 7,799,398 | B2 | 9/2010 | Nakamura et al. | |
| 7,979,004 | B2 | 7/2011 | Tanaka et al. | |
| 8,374,531 | B2 * | 2/2013 | Nakagawa | G03G 15/0808 399/265 |
| 8,600,273 | B2 | 12/2013 | Yamada et al. | |
| 8,655,222 | B2 | 2/2014 | Nakamura et al. | |
| 8,655,238 | B2 | 2/2014 | Uno et al. | |
| 8,660,472 | B2 | 2/2014 | Kurachi et al. | |
| 8,706,011 | B2 | 4/2014 | Anan et al. | |
| 8,768,226 | B2 | 7/2014 | Koyanagi et al. | |
| 8,768,227 | B2 | 7/2014 | Urushihara et al. | |
| 8,774,677 | B2 | 7/2014 | Sakurai et al. | |
| 8,798,508 | B2 | 8/2014 | Yamada et al. | |
| 8,837,985 | B2 | 9/2014 | Ishida et al. | |
| 8,846,287 | B2 | 9/2014 | Yamada et al. | |
| 8,874,007 | B2 | 10/2014 | Kawamura et al. | |
| 9,017,239 | B2 | 4/2015 | Ishida et al. | |
| 9,482,986 | B2 | 11/2016 | Sakurai et al. | |
| 9,625,854 | B2 | 4/2017 | Koyanagi et al. | |
| 9,846,407 | B2 | 12/2017 | Nakamura et al. | |
| 9,921,518 | B2 | 3/2018 | Sakurai et al. | |
| 9,952,531 | B2 | 4/2018 | Ishii et al. | |
| 9,952,532 | B2 | 4/2018 | Sugiyama et al. | |
| 10,082,741 | B2 | 9/2018 | Ishida et al. | |
| 2006/0067747 | A1 | 3/2006 | Matsuda et al. | |
| 2006/0226572 | A1 | 10/2006 | Tanaka et al. | |
| 2013/0130022 | A1 | 5/2013 | Uesugi et al. | |
| 2013/0164038 | A1 | 6/2013 | Kusaba et al. | |
| 2013/0266339 | A1 | 10/2013 | Sugiyama et al. | |
| 2016/0025842 | A1 | 9/2016 | Yuji et al. | |
| 2017/0097580 | A1 | 4/2017 | Kazutoshi et al. | |
| 2017/0139336 | A1 | 5/2017 | Nagaoka et al. | |
| 2017/0248867 | A1 | 8/2017 | Sakurai et al. | |
| 2019/0018362 | A1 | 1/2019 | Morishita et al. | |

FOREIGN PATENT DOCUMENTS

| | | | |
|---|---|---|---|
| JP | H07-160113 | A | 6/1995 |
| JP | H10-111599 | A | 4/1998 |
| JP | 2016-164654 | A | 9/2016 |
| JP | 2017-72831 | A | 4/2017 |

* cited by examiner

DEVELOPING MEMBER HAVING OUTER SURFACE WITH INDEPENDENT ELECTRICALLY INSULATING DOMAINS, ELECTROPHOTOGRAPHIC PROCESS CARTRIDGE, AND ELECTROPHOTOGRAPHIC IMAGE FORMING APPARATUS

BACKGROUND OF THE INVENTION

Field of the Invention

The present disclosure relates to electrophotographic developing members, and also relates to electrophotographic process cartridges and electrophotographic image forming apparatuses.

Description of the Related Art

A developing method involving using a non-magnetic one-component toner has been known as an image forming method used in electrophotographic image forming apparatuses such as copiers, fax machines, and printers. Specifically, an electrophotographic photosensitive member, which is a rotatable electrostatic latent image bearing member, is charged by a charging unit such as a charging roller, and the charged surface of the photosensitive member is exposed to laser to form an electrostatic latent image. Next, a toner in a toner container is applied onto a developing member by a toner feed roller in an electrophotographic process cartridge in the image forming apparatus. The applied toner is regulated by a toner regulating member to form a toner layer, and the electrostatic latent image is developed with the toner in the contact portion between the photosensitive member and the developing member. Subsequently, the toner image on the photosensitive member is transferred onto recording paper with or without an intermediate transfer belt in a transfer unit. The toner image is fixed onto the recording paper by heat and pressure in a fixing apparatus. The recording paper having a fixed image is discharged to the outside of the image forming apparatus.

In such an image forming method, the developing apparatus is composed of electrophotographic members as follows.

(1) A toner feed roller which is present within a toner container, feeds a toner to a developing member, and scrapes the toner after developing by a developing member.

(2) A toner regulating member which forms a toner layer on the developing member, and controls the toner on the developing member into a predetermined amount.

(3) A developing member which is disposed such that the opening of a toner container accommodating the toner is closed, part thereof is exposed to the outside of the container, and the exposed portion faces the photosensitive member, the developing member developing the toner onto the photosensitive member.

These electrophotographic members rotate or slide to perform developing.

Japanese Patent Application Laid-Open No. H07-160113 discloses a toner carrier (developing member) which comprises an electroconductive portion whose surface has a high electric resistance, and can transfer a toner by electrically adsorbing the toner to a charged dielectric portion.

Japanese Patent Application Laid-Open No. H06-130792 discloses a developing apparatus comprising a developer carrier having a surface having a mixed distribution of dielectric portions and electroconductive portions, and a developer charging unit, wherein a desired amount of toner layer applied with a desired amount of charge can be formed on the surface of the developer carrier (developing member) even without a toner feed roller and can be fed onto an image bearing member.

SUMMARY OF THE INVENTION

One aspect according to the present disclosure is directed to providing a developing member having a toner transfer ability having low environmental dependency. Another aspect of the present disclosure is directed to providing an electrophotographic process cartridge capable of providing high-quality electrophotographic images stably. Further aspect of the present disclosure is directed to providing an electrophotographic image forming apparatus which can stably form high-quality electrophotographic images.

According to one aspect of the present disclosure, there is provided an electrophotographic developing member including a substrate, and an electroconductive layer on the substrate, wherein the electroconductive layer has electrically insulating domains (hereinafter, referred to as "domains") on an outer surface thereof, the domains being independent from each other, the developing member has an outer surface including a surface of the electroconductive layer and surfaces of the domains, and wherein, when each of the domains is orthographically projected onto the outer surface of the electroconductive layer, defining respective areas of projected images of the domains as S, and defining respective areas of convex envelopes of the projected images of the domains as H, at least one of the domains satisfies a relation represented by Expression (1):

$$0.05 \leq S/H \leq 0.80 \quad (1).$$

According to another aspect of the present disclosure, there is provided an electrophotographic process cartridge configured to be detachably mountable on an electrophotographic image forming apparatus, and including at least a toner container containing a toner and a developing unit which transfers the toner, wherein the developing unit has the developing member described above.

According to further aspect of the present disclosure, there is provided an electrophotographic image forming apparatus including at least an electrophotographic photosensitive member, a charging unit disposed to be capable of charging of the electrophotographic photosensitive member, and a developing unit which feeds a toner to the electrophotographic photosensitive member, wherein the developing unit includes the developing member described above.

Further features of the present disclosure will become apparent from the following description of exemplary embodiments with reference to the attached drawings.

BRIEF DESCRIPTION OF THE DRAWINGS

FIG. 2A is a diagram illustrating an orthographically projected image of the domain. FIG. 2B is a diagram illustrating the relation between the orthographically projected image of the domain and the convex envelope region, and FIG. 2C is a diagram illustrating only the convex envelope region.

FIG. 3A is a diagram illustrating a domain not having an electroconductive layer surface surrounded by the convex envelope of the domain. FIG. 3B is a diagram illustrating a domain having an electroconductive layer surface surrounded by the convex envelope of the domain.

FIG. 4A is a diagram illustrating a configuration composed of a single layer of electroconductive layer and domains disposed on the outer surface thereof. FIG. 4B is a diagram illustrating a configuration of domains present in the electroconductive layer and exposed from the outer surface thereof. FIG. 4C is a diagram illustrating a configuration composed of two layers of electroconductive layer and domains present on the outer surface thereof.

DESCRIPTION OF THE EMBODIMENTS

Figure 1:
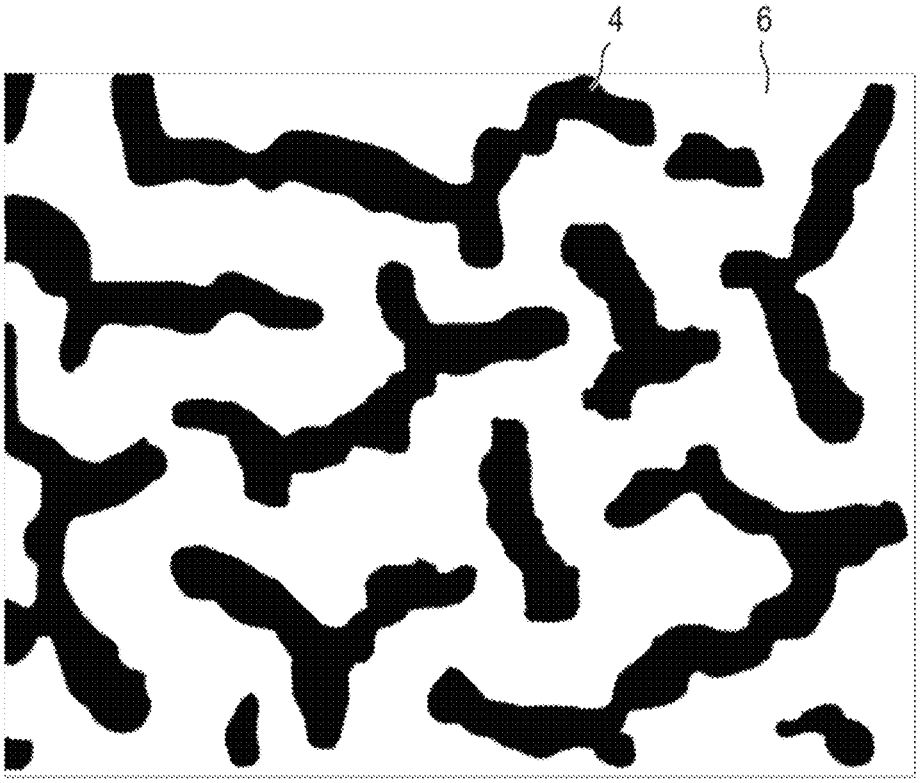
FIG. 1 is a partially enlarged view of a surface of a developing member according to one aspect of the present disclosure.

Preferred embodiments of the present disclosure will now be described in detail in accordance with the accompanying drawings.

As a result of research by the present inventors, the developing members according to Japanese Patent Application Laid-Open No. H07-160113 and Japanese Patent Application Laid-Open No. H06-130792 provide variation in the amount of toner transferred according to the ambient temperature and humidity in some cases. Specifically, the toner transfer ability was reduced in some cases under a high temperature and high humidity environment, e.g., at a temperature of 30° C. and a relative humidity of 80%, compared to that under normal temperature and normal humidity environment, e.g., a temperature of 23° C. and a relative humidity of 50%.

The present inventors have surmised the reason why the toner transfer ability of the developing members according to Japanese Patent Application Laid-Open No. H07-160113 and Japanese Patent Application Laid-Open No. H06-130792 is readily varied according to the environment in which the developing member is placed as follows.

Specifically, the developing members according to Japanese Patent Application Laid-Open No. H07-160113 and Japanese Patent Application Laid-Open No. H06-130792 each have dielectric portions and electroconductive portions on the surface thereof. If toner particles roll on such a surface, the dielectric portions are charged and a gradient force acts to the toner particles by the small fringe electric field formed between the dielectric portions and the electroconductive portions to attract the toner particles to the dielectric portions. Then, the gradient force also varies if the conductivities of the dielectric portions vary according to the ambient environment. For example, under a high temperature and high humidity environment, the electric resistances in of the dielectric portions are reduced and the dielectric portions are barely charged. For this reason, the gradient force is reduced, and thus the toner particles attracted to the dielectric portions are reduced. As a result, the amount of toner particles transferred is reduced.

The present inventors have conducted extensive research to attain a developing member having reduced environmental dependency of the amount of toner particles transferred. As a result, the present inventors have found that an electrophotographic developing member having the following configuration can achieve the object above well.

Specifically, the electrophotographic developing member according to one aspect of the present disclosure includes a substrate, and an electroconductive layer on the substrate, wherein the electroconductive layer has electrically insulating domains on an outer surface thereof, the domains being independent from each other, the developing member has an outer surface including a surface of the electroconductive layer and surfaces of the domains, and wherein, when each of the domains is orthographically projected onto the outer surface of the electroconductive layer, defining respective areas of projected images of the domains as S, and defining respective areas of convex envelopes of the projected images of the domains as H, at least one of the domains satisfies a relation represented by Expression (1):

$$\leq S/H \leq 0.80 \quad (1).$$

FIG. 1 is a partially enlarged view of a surface of a developing member according to one aspect of the present disclosure. In FIG. 1, the surface of the developing member is composed of electrically insulating domains 4 independent from each other and an exposed portion 6 of the electroconductive layer not coated with the domains 4.

The domains have a volume resistivity of $1.0\times10^{13}$ Ω·cm or more and $1.0\times10^{18}$ Ω·cm or less, for example. The electroconductive layer has a volume resistivity of $1.0\times10^{12}$ Ω·cm or less, particularly $1.0\times10^{11}$ Ω·cm or less, for example. The lower limit is not particularly limited, and is $1.0\times10^{1}$ Ω·cm or more, for example.

Figure 2A:
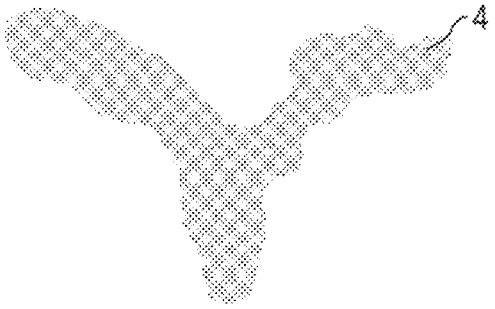
FIGS. 2A, 2B and 2C are a diagram illustrating a domain in the developing member according to one aspect of the present disclosure.
Figure 2B:
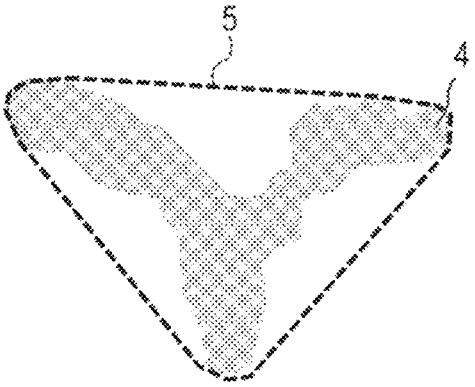
Figure 2C:
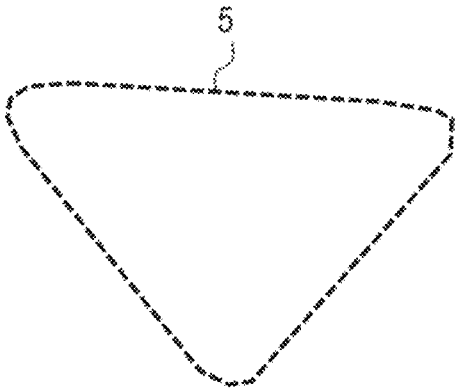

FIG. 2A illustrates an orthographically projected image of a domain 4. FIG. 2B illustrates a convex envelope region 5 of the domain. The domain has an area solidity S/H of 0.05 or more and 0.80 or less where S represents the area of the domain 4 and H represents the area of the convex envelope region 5. Hereinafter, "S/H" is also referred to as "area solidity".

The domains having such a shape increase the amount of toner particles transferred by the developing member. The present inventors infer the reason for this as follows.

In the developing member according to the present aspect, the toner particles roll on the surface thereof and the domains are charged. As a result, an electric field is generated between the domains and the electroconductive layer surface. As a result, a gradient force acts on the toner particles present around the domains, and the toner particles are adsorbed to the domains.

Figure 3A:
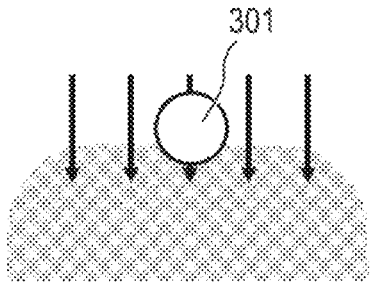
FIGS. 3A and 3B are a diagram illustrating a mechanism to exhibit the effect of the electrophotographic developing member according to the present disclosure.

Here, for the domains having a shape illustrated in FIG. 3A, the toner particles on which the gradient force acts and which are thus attracted to the domains are substantially only toner particles 301 present near the outer edges of the domains.

Figure 3B:
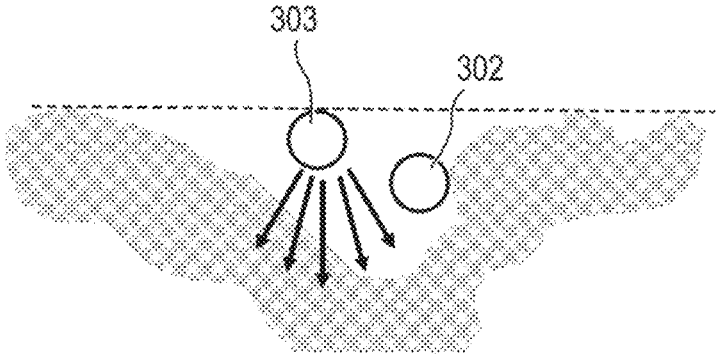

In contrast, as illustrated in FIG. 3B, for the domains having a shape according to the present aspect, the gradient force can act on a toner particle 303 located between the outer edge of the domain and the convex envelope region 5 in the exposed portion of the electroconductive layer in addition to the toner particle 302 located near the outer edge of the domain. This is probably because the electric field becomes dense in the region between the outer edge of the domain and the convex envelope region 5. As a result, the number of toner particle attracted to the domains can be increased. An increase in the number of toner particles attracted to the domains also increases the number of toner particles rolling on the surface of the domain, therefore relatively increasing the amount of charge of the domain. As a result, a reduction in the amount of charge attributed to a reduction in electric resistances of the domains under a high temperature and high humidity environment can be compensated. It is considered that because of such a mechanism, the developing member according to the present aspect can suppress a reduction in toner transfer ability under a high temperature environment, which was observed in the developing members according to Japanese Patent Application Laid-Open No. H07-160113 and Japanese Patent Application Laid-Open No. H06-130792.

<Method of Calculating Area Solidity of Domain>

The domain can be determined as a difference in reflectance intensity because the surface thereof is different in the form from that of the electroconductive layer. The domain can be determined using an optical microscope or an electronic microscope, for example. The domains have a different electrical resistivity from that of the electroconductive layer. For this reason, the domains can be more clearly determined using an electrostatic force microscope (EFM) in combination. Specifically, examples of the optical microscope include "DIGITAL MICROSCOPE VHX-5000" (trade name, made by Keyence Corporation). Examples of the electronic microscope include "JSM-7800FPRIME" (trade name, made by JEOL, Ltd.). Examples of the electrostatic force microscope include "MODEL 1100TN" (trade name, made by Trek Japan, K.K.).

The value of S/H of the domain can be determined by binarizing the images observed using a variety of microscopes listed above. Binarization can be more easily performed by selecting the optical condition in the optical microscope so as to increase the difference between the reflectance intensity of the domains and that of the electroconductive layer. Here, the area H of the convex envelope of the orthographically projected image of the domain can be measured using image treatment software which is commercially available or usually usable. The region of the convex envelope may be calculated by any known method which can generate the region of the convex envelope, such as known Quickhull algorithm or Graham's scan algorithm. Alternatively, the area solidity S/H can also be calculated using image treatment software which is commercially available or usually usable. Such image treatment software usable is Image J ver. 1.45 (developed by: Wayne Rasband National Institutes of Health, NIH).

In the developing member according to the present aspect, 20 number % or more, preferably 40 number % or more, more preferably 60 number % or more of domains based on the total number of domains preferably satisfy the relation represented by Expression (1). This is effective in more reduction of the environmental dependency of the amount of toner particles transferred.

In the developing member according to the present aspect, the percentage of the number of domains satisfying the range represented by Expression (1) can also be determined using a variety of microscopes and image treatment software as described above.

Among the domains in the developing member according to the present aspect, 80 number % or more of domains preferably has an area S in the range of 300 $\mu m^2$ or more and 100000 $\mu m^2$ or less. With an area S of 300 $\mu m^2$ or more, the area of the electroconductive layer surface surrounded by the convex envelope is sufficiently large to the toner, and therefore the effects according to the present aspect is readily obtained. With an area S of 100000 $\mu m^2$ or less, the domains barely cause image defects such as dots images even if excessively charged. Accordingly, by controlling the percentage of the number of domains having the area S within the above described range to 80 number % or more, the developing member has a high toner transfer ability both of under a low temperature and low humidity environment and under a high temperature and high humidity environment, and excessive charging of the developing member can be prevented.

Figure 5:
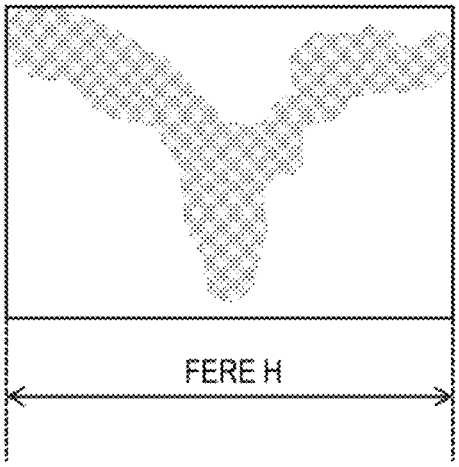
FIG. 5 is a diagram illustrating one example of a horizontal Feret's diameter of an orthographically projected image of the domain in the electrophotographic developing member according to the present disclosure.

In the developing member according to the present aspect, the domains preferably have an arithmetic average of the horizontal Feret's diameter of 100 μm or more and 2000 μm or less. FIG. 5 is a diagram illustrating one example of the horizontal Feret's diameter of the orthographically projected image of a domain in the electrophotographic developing member according to the present disclosure. The vertical direction of FIG. 5 indicates the longitudinal direction of the developing member. As illustrated in FIG. 5, one side of a rectangle circumscribing the orthographically projected image of the domain is drawn so as to be parallel to the longitudinal direction of the developing member, and the length of the side is defined as the horizontal Feret's diameter. When the arithmetic average of the horizontal Feret's diameter is 100 μm or more, a mechanical transfer force is generated by the toner adsorbed onto the domains, improving the toner transfer force. When the arithmetic average of the horizontal Feret's diameter is 2000 μm or less, the domains barely cause image defects such as dots images even if excessively charged.

In the outer surface of the developing member according to the present aspect, the total of the areas S of the domains located in a rectangular region (side in the longitudinal direction: 3.0 mm, side in the circumferential direction: 1.0 mm) is preferably 15% or more and 50% or less of the area of the region. By controlling the total within this range, the developing member has a high toner transfer ability both of under a low temperature and low humidity environment and under a high temperature and high humidity environment, and excessive charging of the developing member can be prevented.

Domains each have a thickness of preferably 0.1 μm or more and 10.0 μm or less. With a thickness of 0.1 μm or more, the domains are readily charged. With a thickness of 10.0 μm or less, excessive charging of the domains is readily prevented. More preferably, the domains have a thickness of 0.5 μm or more and 3.0 μm or less.

The domains preferably have a volume resistivity of $1\times10^{14}$ Ω·cm or more and $1\times10^{17}$ Ω·cm or less. At a volume resistivity within this range, the domains are readily charged. The electroconductive layer preferably has a volume resistivity of $1\times10^{10}$ Ω·cm or less.

Examples of the method of measuring the volume resistance of the domains and that of the conductive elastic layer from the developing member include the following methods.

A domain region and a conductive elastic layer region are cut out from the developing member, and a thin leaf sample of a square having an plane size of 50 μm and a thickness t of 100 nm are prepared therefrom with a microtome. Next, this thin leaf sample is placed on a metal flat plate, and a metal terminal having an area S of 100 $\mu m^2$ is pressed against the thin leaf sample from above. In this state, a voltage of 10 V is applied between the metal terminal and the metal flat plate by an electrometer 6517B made by KEITHLEY INSTRUMENTS to determine the resistance R. From the resistance R, the volume resistivity ρv (Ω·cm) is calculated using Expression (2):

$$\rho v = R \times S/t \quad (2).$$

Figure 4A:
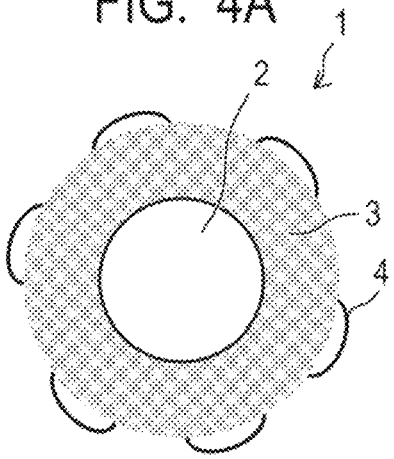
FIGS. 4A, 4B and 4C are a schematic cross-sectional diagram illustrating one example of the electrophotographic developing member according to the present disclosure.
Figure 4B:
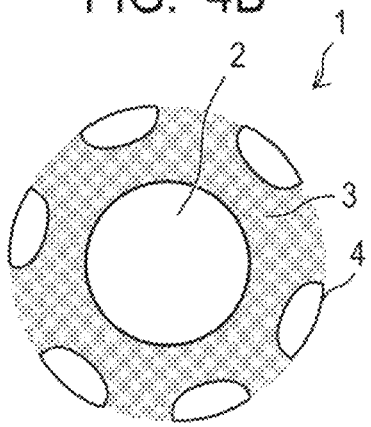
Figure 4C:
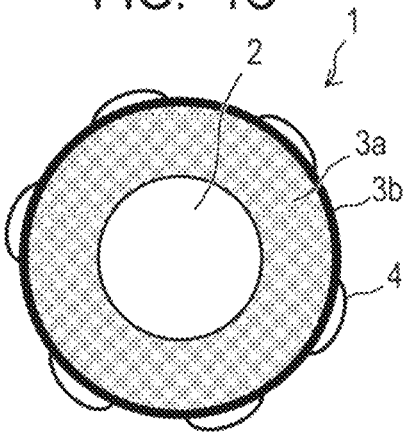

FIGS. 4A to 4C are cross-sectional diagrams of the developing member according to the present aspect in the direction intersecting perpendicular to the longitudinal direction. The developing member according to the present aspect includes a substrate, and an electroconductive layer thereon, the surface of the electroconductive layer and the surfaces of the domains being disposed on the outer surface of the electroconductive layer. Here, the outer surface of the electroconductive layer of the developing member is typically a surface contacting another member (such as an electrophotographic photosensitive member or a toner regulating member). If the developing member is a roller, the surface thereof means the outer peripheral surface of a portion where the electroconductive layer (cylindrical) on the substrate is disposed. Specific examples thereof include a configuration illustrated in FIG. 4A, in which a developing member 1 includes a substrate 2, an electroconductive layer 3 on the substrate, and electrically insulating domains 4 present on the outer surface of the electroconductive layer. The developing member may have a configuration illustrated in FIG. 4B, in which domains are present in the electroconductive layer and exposed from the outer surface thereof. Furthermore, as illustrated in FIG. 4C, the electroconductive layer 3 may be a laminate composed of a first electroconductive layer 3*a* and a second electroconductive layer 3*b*.

Examples of the method of forming the domains include a method including applying a material for forming the domains onto an electroconductive layer using a printing method such as ink jetting or screen printing, a method including applying a material for forming the domains (coating material) onto an electroconductive layer by a wet coating method such as spraying or dipping, and a method including mixing a constitutional material for domains with that for an electroconductive layer, and phase separating the materials on the optimal condition to form domains.

In use of ink jetting, a coating material for forming domains is applied onto the surface of an electroconductive layer by ink jetting such that the area solidity S/H is 0.05 to 0.80.

In use of the wet coating method, for example, the coating material for forming domains is applied onto the electroconductive layer by wet coating, and the coating material is caused to repel on the surface of the electroconductive layer, thereby forming domains such that the area solidity S/H is 0.05 to 0.80. Examples of the method of repelling the coating material on the surface of the electroconductive layer to form domains having a predetermined shape include adjustment of the contact angle of the coating material on the surface of the electroconductive layer, adjustment of the molecular weight of the solid content in the coating material, and selection of the types of solvent in the coating material.

The coating material preferably has a contact angle of 10° or more and 90° or less with respect to the outer surface of the electroconductive layer. More preferably, the coating material has a contact angle of 20° or more and 50° or less with respect to the outer surface of the electroconductive layer. A contact angle of 10° or more facilitates formation of domains independent from each other. At a contact angle of 90° or less, the value of S/H of the surface shape of the domains is readily controlled within the range of 0.05 to 0.80.

The solid content in the coating material has a molecular weight of preferably 2500 or more, more preferably 10000 or more. An increase in molecular weight facilitates control of the value of the area solidity S/H of the domains within the range of 0.05 to 0.80.

Furthermore, a solvent having a boiling point of 50° C. or more and 200° C. or less can be selected as a solvent for the coating material to adjust the drying rate of the coating material on the surface layer to thereby easily controlling the area S of the domains. Specifically, a solvent having a higher boiling point can delay the drying of the coating material and thus increase the area S. Examples of such a solvent include acetone (boiling point: 56.1° C.), methanol (boiling point: 64.5° C.), hexane (boiling point: 68.7° C.), ethanol (boiling point: 78.3° C.), methyl ethyl ketone (MEK, boiling point 79.6° C.), cyclohexane (boiling point: 80.7° C.), heptane (boiling point: 98.4° C.), toluene (boiling point: 110.6° C.), methyl isobutyl ketone (MiBK, boiling point: 116.2° C.), and diisobutyl ketone (DiBK, (boiling point: 168.4° C.). Among these solvents, acetone, MEK, and MiBK are suitably used in view of the solubility of the material for forming the domains and the viscosity of the solution.

The drying rate may be adjusted by adding a liquid component other than the solvent, such as a monomer.

The horizontal Feret's diameter of the domains can be controlled by the surface roughness (Ra) of the electroconductive layer. For example, an increase in the surface roughness of the electroconductive layer can reduce the horizontal Feret's diameter. Examples of the method therefor include adjusting the amount of resin particles added to the electroconductive layer.

[Mandrel (Substrate)]

A mandrel has a cylindrical or hollow cylindrical shape, and is made of the following electroconductive material: metals or alloys such as aluminum, copper alloy, stainless steel, and free cutting steel; chromium- or nickel-plated iron; and conductive synthetic resins. A known adhesive may be appropriately applied onto the surface of the mandrel in order to improve the adhesiveness to the elastic layer disposed on the outer peripheral surface the mandrel.

[Electroconductive Layer]

The electroconductive layer includes an elastic material such as resin and rubber. Examples of the resin and rubber specifically include polyamide, nylon, polyurethane resin, urea resin, polyimide, melamine resin, fluorinated resin, phenol resin, alkyd resin, polyester, polyether, acrylic resin, and mixtures thereof; and ethylene-propylene-diene copolymerization rubber (EPDM), acrylonitrile-butadiene rubber (NBR), chloroprene rubber (CR), natural rubber (NR), isoprene rubber (IR), styrene-butadiene rubber (SBR), fluorocarbon rubber, silicone rubber, epichlorohydrin rubber, and hydrides of NBR. Among these, the polyurethane resin is preferred because it has high frictional charging ability to the toner, has high flexibility to increase the contact with the toner, and has resistance to wear. Also in the case where the electroconductive layer has a laminate configuration of two or more layers, use of the polyurethane resin for the outermost surface electroconductive layer (upper layer) is preferred. Examples of the polyurethane resin include ether polyurethane resin, ester polyurethane resin, acrylic polyurethane resin, fluorine polyurethane resin, carbonate polyurethane resin, and olefin urethane resin.

The polyurethane resin can be prepared from polyol and isocyanate, and a chain extender can be used therefor when necessary. Examples of polyols as a raw material for the polyurethane resin include polyether polyol, polyester polyol, polycarbonate polyol, polyolefin polyol, acrylic polyol, and mixtures thereof. Examples of the isocyanate as a raw material for the polyurethane resin include tolylene diisocyanate (TDI), diphenylmethane diisocyanate (MDI), naphthalene diisocyanate (NDI), tolidine diisocyanate (TODI), hexamethylene diisocyanate (HDI), isophorone diisocyanate (IPDI), phenylene diisocyanate (PPDI), xylylene diisocyanate (XDI), tetramethylxylylene diisocyanate (TMXDI), cyclohexane diisocyanate, and mixtures thereof. Examples of the chain extender as a raw material for the polyurethane resin include bifunctional low-molecule diols such as ethylene glycol, 1, 4-butanediol, and 3-methylpentanediol; trifunctional low-molecule triols such as trimethylolpropane; and mixtures thereof.

In the case where the electroconductive layer has a laminate configuration of two or more layers, silicone rubber is preferred as a material forming the electroconductive layer (lower layer) on the mandrel. Examples of the silicone rubber include polydimethylsiloxane, polymethyltrifluoropropyl siloxane, polymethylvinylsiloxane, polyphenylvinylsiloxane, and copolymers of these siloxanes. These resins and rubbers can be used alone or in combination when necessary. The materials for the resin and rubber can be identified through measurement using a Fourier transform infrared spectrophotometer.

The electroconductive layer can further contain a variety of additives such as particles, a conductive agent, a plasticizer, a filler, an extender, a vulcanizing agent, a vulcanizing aid, a crosslinking aid, a curing inhibitor, an antioxidant, an anti-ageing agent, and a treatment aid when necessary. These optional components can be compounded in amounts in the ranges not inhibiting the functions of the electroconductive layer.

The particles contained in the electroconductive layer can form protrusions on the outer surface of the electrophotographic member. The particles which can be added to the electroconductive layer preferably have a volume average particle diameter of 1 μm or more and 30 μm or less. The particle diameter can be measured by observing the cross-sectional surface with a scanning electron microscope (trade name: JSM-7800 FPRIME Schottky field emission scanning electron microscope, made by JEOL, Ltd.).

The amount of the particles contained in the electroconductive layer is preferably 1 part by mass or more and 50 parts by mass or less relative to 100 parts by mass of the elastic material such as the resin or the rubber. The particles can be fine particles composed of a resin such as polyurethane resin, polyester, polyether, polyamide, acrylic resin, or polycarbonate. Among these, polyurethane resin particles are preferred because they are soft. Protrusions of polyurethane resin particles largely crush when the electrophotographic member is brought into contact with another member, causing complex deformation. Such deformation is effective in preventing the contamination by the toner.

The electroconductive layer can be a conductive elastic layer formed of the elastic material compounded with a conductive agent such as the electronically conductive substance or an ionically conductive substance. Examples of the electronically conductive substance include the following substances: conductive carbon, such as carbon black such as ketjen black EC and acetylene black; carbons for rubber such as SAF (Super Abrasion Furnace), ISAF (Intermediate SAF), HAF (High Abrasion Furnace), FEF (Fast Extruding Furnace), GPF (General Purpose Furnace), SRF (Semi-Reinforcing Furnace), FT (Fine Thermal), and MT (Medium Thermal); carbons for color (ink) subjected to oxidation treatment; and metals such as copper, silver, and germanium and metal oxides thereof. Among these, conductive carbon is preferred because conductivity is readily controlled with a small amount thereof. Examples of the ionically conductive substance include the following substances: ionically conductive inorganic substances such as sodium perchlorate, lithium perchlorate, calcium perchlorate, and lithium chloride; and ionically conductive organic substances such as modified aliphatic dimethylammonium ethosulfate and stearylammonium acetate.

Examples of the filler include silica, quartz powder, and calcium carbonate.

The materials for the electroconductive layer can be mixed with a dynamic mixing machine such as a single screw continuous kneader, a twin screw continuous kneader, a two-roll mill, a kneader mixer, or a trimix or a static mixing machine such as a static mixer.

Examples of the method of forming an electroconductive layer on a mandrel can include die molding, extrusion molding, injection molding, and application molding. A method of forming a first region in which protrusions are formed will be described later. In die molding, for example, first, bridges for holding a mandrel in a cylindrical metal die are fixed to both ends of the metal die, and inlets are formed in the bridges. In the next step, the mandrel is placed in the metal die, and the material for an electroconductive layer is injected from the inlets. The metal die is heated at a temperature at which the material cures, and is removed. In extrusion molding, for example, a mandrel and a material for an elastic layer are co-extruded using a crosshead extruder. The material is cured to form an electroconductive layer around the mandrel.

When the electroconductive layer is configured as a laminate of two or more layers, the surface of the electroconductive layer (lower layer) on the mandrel side may be polished to improve the adhesion, or may also be modified by a surface modification technique such as corona treatment, frame treatment, or excimer treatment.

Examples of the material for forming domains include resins and metal oxides. Among these, resins are preferred because they can be more easily charged.

Specific examples of the resin include acrylic resins, polyolefin resins, epoxy resins, and polyester resins.

Among these, acrylic resins are preferred because they can facilitate the control of the volume resistivity of the domains within the range above. Examples of the acrylic resins specifically include polymers and copolymers prepared with the following monomers as raw materials: methyl methacrylate, 4-tert-butylcyclo hexanol acrylate, stearyl acrylate, lauryl acrylate, 2-phenoxyethyl acrylate, isodecyl acrylate, isooctyl acrylate, isobornyl acrylate, 4-ethoxylated nonylphenol acrylate, and ethoxylated bisphenol A diacrylate.

[Electrophotographic Process Cartridge and Electrophotographic Image Forming Apparatus]

The electrophotographic image forming apparatus according to the present aspect includes an electrophotographic photosensitive member for forming and carrying an electrostatic latent image, a charging unit for charging the electrophotographic photosensitive member, and an exposure apparatus for forming an electrostatic latent image on the charged electrophotographic photosensitive member. Furthermore, the electrophotographic image forming apparatus includes a developing unit for developing the electrostatic latent image with a toner to form a toner image, and a transfer unit for transferring the toner image to a transfer material. The developing unit includes the developing member above as a developing member, for example.

Figure 6:
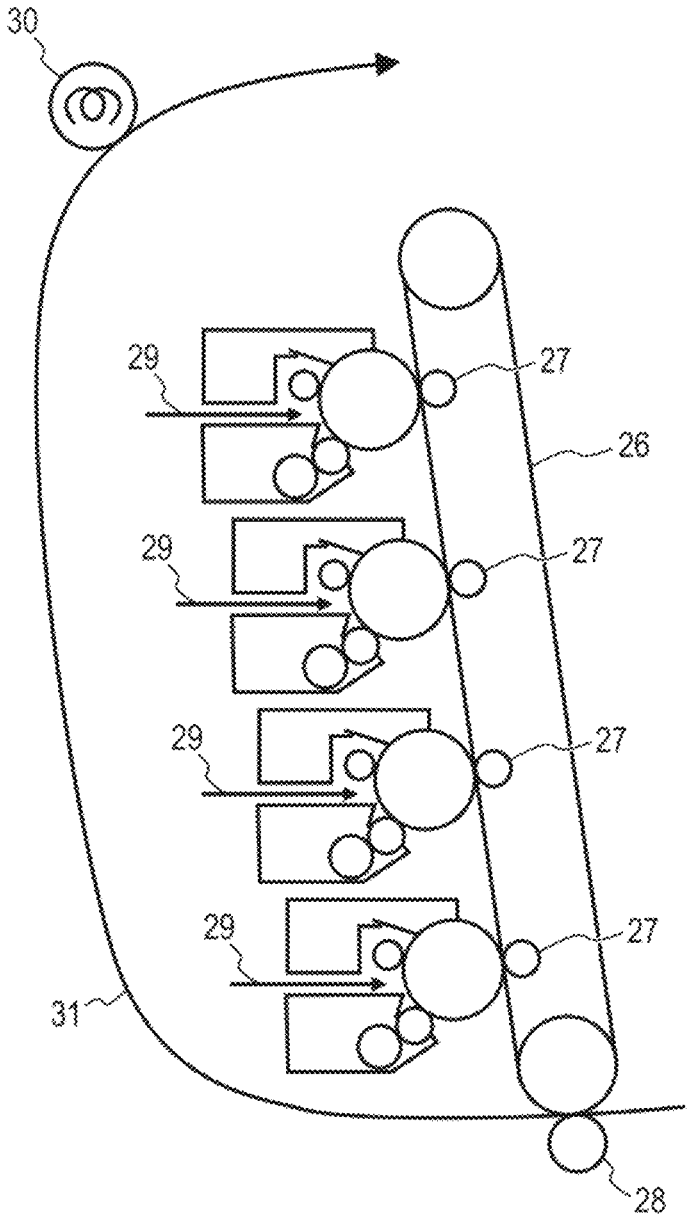
FIG. 6 is a schematic block diagram illustrating one example of an electrophotographic image forming apparatus according to the present disclosure.
Figure 7:
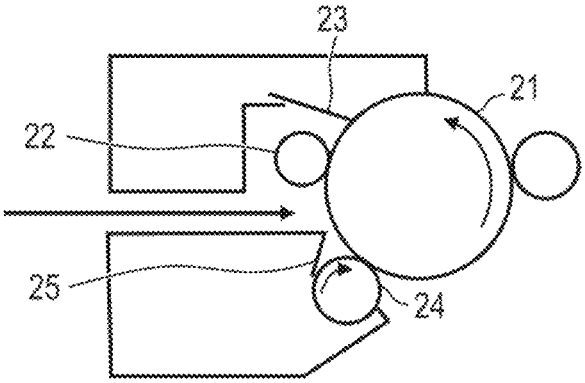
FIG. 7 is a schematic block diagram illustrating one example of an electrophotographic process cartridge according to the present disclosure.

FIG. 6 illustrates an outline of one example of the electrophotographic image forming apparatus according to the present aspect. FIG. 7 illustrates an outline of an electrophotographic process cartridge mounted on the electrophotographic image forming apparatus in FIG. 6. This electrophotographic process cartridge includes an electrophotographic photosensitive member 21, a charging member 22 disposed to be capable of charging the electrophotographic photosensitive member 21, a developing member 24, a cleaning member 23, and a toner regulating member 25, which are built in the electrophotographic process cartridge. The electrophotographic process cartridge is configured to be detachably attached to the main body of the electrophotographic image forming apparatus in FIG. 6.

The electrophotographic photosensitive member 21 is uniformly charged (primarily charged) by the charging member 22 connected to a bias power supply not illustrated. The image bearing member at this time has a charging potential of −800 V or more and −400 V or less, for example. Next, the electrophotographic photosensitive member is irradiated with exposure light 29 for writing the electrostatic latent image, which is emitted from an exposure apparatus not illustrated, and the electrostatic latent image is formed on the surface thereof. The exposure light to be used can be either of LED light and laser light. The exposed portion of the electrophotographic photosensitive member has a surface potential of −200 V or more and −100 V or less, for example.

Next, the toner charged by the developing member 24 to have negative polarity is applied to the electrostatic latent image (developed), forming a toner image on the electrophotographic photosensitive member to convert the electrostatic latent image into a visible image. At this time, a voltage of −500 V or more and −300 V or less is applied to the developing member by a bias power supply not illustrated, for example. The developing member is in contact with the image bearing member with a nip width of 0.5 mm or more and 3 mm or less, for example.

The toner image developed on the electrophotographic photosensitive member is primarily transferred onto the intermediate transfer belt 26. The primary transfer member 27 is in contact with the rear surface of the intermediate transfer belt 26. By applying a voltage of +100 V or more and +1500 V or less to the primary transfer member 27, for example, the toner image having negative polarity is primarily transferred from the image bearing member to the intermediate transfer belt 26. The primary transfer member 27 may have a roller shape or a blade shape.

When the electrophotographic image forming apparatus is a full-color image forming apparatus, typically the steps of the charging, the exposure, the developing, and the primary transfer are performed with colors of yellow, cyan, magenta, and black. For this, the electrophotographic image forming apparatus illustrated in FIG. 6 includes four built-in electrophotographic process cartridges in total containing the toners of these colors, respectively. The four electrophotographic process cartridges are detachably mounted on the main body of the electrophotographic image forming apparatus. The steps of the charging, the exposure, the developing, and the primary transfer are sequentially performed at a predetermined interval of time, forming a state where toner images of four colors for representing a full-color image are layered on the intermediate transfer belt 26.

The toner image of the intermediate transfer belt 26 is transported to a position facing the secondary transfer member 28 with the rotation of the intermediate transfer belt 26. Paper for recording is conveyed between the intermediate transfer belt 26 and the secondary transfer member 28 along the conveying route 31 of the paper for recording at a predetermined timing. A secondary transfer bias is applied to the secondary transfer member 28 to transfer the toner image of the intermediate transfer belt 26 onto the paper for recording. At this time, the bias voltage applied to the secondary transfer member 28 is +1000 V or more and +4000 V or less, for example. The paper for recording having a toner image transferred by the secondary transfer member 28 is conveyed by the fixing apparatus 30. The toner image on the paper for recording is melted and fixed onto the paper for recording. The paper for recording is then discharged to the outside of the electrophotographic image forming apparatus, completing the print operation.

According to one aspect of the present disclosure, an electrophotographic developing member having a toner transfer ability which barely varies due to a change in the surrounding environment can be attained. According to another aspect according to the present disclosure, an electrophotographic process cartridge which can stably form high-quality electrophotographic images can be attained. According to another aspect according to the present disclosure, an electrophotographic image forming apparatus which can stable form high-quality electrophotographic images can be attained.

EXAMPLES

Hereinafter, the electrophotographic developing member, the electrophotographic process cartridge, and the electrophotographic image forming apparatus according to the present aspect will be specifically described by way of Production Examples and Examples.

<Preparation of Isocyanate Group-Terminated Prepolymer a>

An isocyanate group-terminated prepolymer a used in preparation of the developing members according to Examples and Comparative Examples was prepared by the following method.

Under a nitrogen atmosphere, polyether polyol (trade name: PTGL1000, made by Hodogaya Chemical Co., Ltd.) (150.0 parts by mass) was gradually added dropwise in polymeric MDI (trade name: made by Millionate MT Tosoh Corporation) (40.5 parts by mass) in a reaction container. During the addition, the temperature in the reaction container was kept at 72° C. After the addition was completed, the reaction was performed at a temperature of 72° C. for 2 hours. The resulting reaction mixture was cooled to room temperature, yielding 110 parts by mass of isocyanate group-terminated prepolymer a (isocyanate group content: 4.7 mass %).

<Preparation of Mandrel>

A primer (trade name: DY35-051; made by Dow Corning Toray Co., Ltd.) was applied onto a solid mandrel made of free cutting steel with electroless nickel plated surface and having an outer diameter of 6 mm and a length of 259.9 mm, and was heated at a temperature of 150° C. for 20 minutes to prepare a mandrel.

<Preparation of Conductive Silicone Rubber Layer>

This mandrel was placed in a metal die, and an addition curable silicone rubber composition prepared by mixing the materials shown in Table 1 with a mixer (trade name: trimix TX-15, made by INOUE MANUFACTURING CO., LTD.) was injected into the cavity of the metal die heated to a temperature of 115° C. After the injection, the metal die was heated at a temperature of 120° C. for 10 minutes to cure the addition curable silicone rubber composition. The mandrel having the cured silicone rubber layer formed thereon was removed from the metal die, and the silicone rubber layer was further heated at a temperature of 150° C. for 15 minutes for secondary curing. Thus, a conductive silicone rubber layer having a thickness of 1.99 mm was formed on the outer periphery of the mandrel.

TABLE 1

| | Material | Parts by mass |
|---|---|---|
| Materials for electroconductive layer (1)-1 | Liquid silicone rubber material (Trade name: SE6724A/B; made by Dow Corning Toray Co., Ltd.) | 100 |
| | Carbon black (Trade name: TOKABLACK#7360SB; made by Tokai Carbon Co., Ltd.) | 10 |
| | Platinum catalyst (Trade name: SIP6832.2, made by Gelest, Inc.) | 0.1 |

* Numerals shown under the column "parts by mass" in the table each shows the mass in terms of the solid content (parts by mass) of the material.

<Preparation of Coating Material for Forming Conductive Urethane Resin>

[Preparation of Coating Material No. S1]

Next, the materials shown in Table 2 were added in the compounding proportion shown in Table 2 to methyl ethyl ketone (MEK) (400 parts by mass) such that the total solid content was 30 mass %, and were dispersed with stirring with a ball mill to prepare a coating material No. S1 for forming a conductive urethane resin layer.

[Preparation of Coating Materials No. S2 to S8]

Coating materials No. S2 to S8 were prepared in the same manner as for the coating material No. S1 except that the materials and compounding proportion were changed as shown in Table 2 below.

TABLE 2

| | | Coating material No. | | | | | | | |
|---|---|---|---|---|---|---|---|---|---|
| | | S1 | S2 | S3 | S4 | S5 | S6 | S7 | S8 |
| Materials for forming conductive urethane resin layer (parts by mass) | Polyether polyol (Trade name: PTGL1000, made by Hodogaya Chemical Co., Ltd.) | 50 | 50 | 50 | 50 | 50 | 50 | 50 | 50 |
| | Isocyanate group-terminated prepolymer a | 50 | 50 | 50 | 50 | 50 | 50 | 50 | 50 |
| | Polyether-modified silicone oil (Trade name: TSF4440, made by Momentive Performance Materials Japan LLC) | 1 | 0.5 | 3 | 1 | 1 | 1 | 5 | |
| | Resin particles (Trade name: C-400 Transparent, made by Negami Chemical Industrial Co., Ltd.) | 7 | 7 | 15 | 10 | 4 | 2 | 7 | 7 |
| | Carbon black (Trade name: MA100, made by Mitsubishi Chemical Corporation) | 20 | 20 | 20 | 20 | 20 | 20 | 20 | 20 |

<Preparation of Electroconductive Member>

[Preparation of Electroconductive Member D-1]

The mandrel having the conductive silicone rubber layer formed thereon was immersed in the coating material No. S1 according to the following procedure to form a coating of the coating material No. S1 on the conductive silicone rubber layer.

Specifically, the upper end of the mandrel was held where the longitudinal direction thereof was coincident with the vertical direction, was immersed in the coating material No. S1, and was lifted to form a coating of the coating material No. S1 on the conductive silicone rubber layer. The immersion time was 9 seconds, and the lift rate from the coating material No. S1 was the initial rate of 30 mm/s and the final rate of 20 mm/s. The lift rate was varied from the initial rate to the final rate linearly against the time. The mandrel having the coating of the coating material No. S1 was placed in an oven, and was heated at a temperature of 80° C. for 15 minutes. The mandrel was further heated in the oven at a temperature of 140° C. for 2 hours to cure the coating, forming a conductive urethane resin layer having a film thickness of 10.0 μm on the conductive silicone rubber layer. A member composed of a laminate of the conductive silicone rubber layer and the conductive urethane resin layer formed on the outer periphery of the mandrel is referred to as an electroconductive member D-1.

Next, the roughness was measured at arbitral nine points of the surface of the conductive urethane resin layer forming the surface of the electroconductive member D-1, and the arithmetic average roughness was determine therefrom. In the determination of the arithmetic average roughness, the roughness was measured using a laser microscope VK-8700 (made by Keyence Corporation) with an object lens of 50×. The average was defined as the surface roughness Ra. The results are shown in Table 3.

[Preparation of Electroconductive Members D-2 to D-8]

Electroconductive members D-2 to D-8 were prepared in the same manner as for the electroconductive member D-1 except that the coating materials shown in Table 3 below were used, and the surface roughness Ra was measured in the same manner as for the electroconductive member D-1. The results are shown in Table 3.

TABLE 3

| | Electro-conductive member | | | | | | | |
|---|---|---|---|---|---|---|---|---|
| | Electro-conductive member D-1 | Electro-conductive member D-2 | Electro-conductive member D-3 | Electro-conductive member D-4 | Electro-conductive member D-5 | Electro-conductive member D-6 | Electro-conductive member D-7 | Electro-conductive member D-8 |
| Coating material No. | S1 | S2 | S3 | S4 | S5 | S6 | S7 | S8 |
| Surface roughness of electro-conductive member Ra (μm) | 1.10 | 1.13 | 1.80 | 1.53 | 0.55 | 0.31 | 1.05 | 1.23 |

<Preparation of Coating Material for Forming Domains>

[Preparation of Coating Material for Forming Domains No. Z1]

Next, the resin for domains was mixed with methyl ethyl ketone (MEK) (100 parts by mass) at the compounding amount shown in Table 4 to prepare a coating material for forming domains No. Z1.

[Preparation of Coating Materials for Forming Domains No. Z2 to Z14]

Coating materials for forming domains No. Z2 to Z14 were prepared in the same manner as for the coating material No. Z1 except that the resin for domains, the compounding amount, and the solvent were used as shown in Table 4.

TABLE 4

| | | Coating material No. | | | | | | | | | | | | | |
|---|---|---|---|---|---|---|---|---|---|---|---|---|---|---|---|
| | | Z1 | Z2 | Z3 | Z4 | Z5 | Z6 | Z7 | Z8 | Z9 | Z10 | Z11 | Z12 | Z13 | Z14 |
| Resin for domains (parts by mass) | Polystyrene resin (Trade name: Polystyrene A-2500, Mw: $3.12 \times 10^3$, made by Tosoh Corporation) | | 10 | | | | | | | | | | | | |
| | Polystyrene resin (Trade name: Polystyrene F-1, Mw: $9.49 \times 10^3$, made by Tosoh Corporation) | | | 10 | | | | | | | | | | | |
| | Polystyrene resin (Trade name: Polystyrene F-4, Mw: $3.72 \times 10^4$, made by Tosoh Corporation) | 10 | | | | 10 | | 10 | 10 | 20 | 15 | 5 | 2.5 | | |
| | Polystyrene resin (Trade name: Polystyrene F-20, Mw: $1.89 \times 10^5$, made by Tosoh Corporation) | | | | 5 | | | | | | | | | 2.5 | |
| | Acrylic resin (Trade name: Hitaroid HA1473, made by Hitachi Chemical Company, Ltd.) | | | | | | 5 | | | | | | | | |

TABLE 4-continued

| | Coating material No. | | | | | | | | | | | | | |
|---|---|---|---|---|---|---|---|---|---|---|---|---|---|---|
| | Z1 | Z2 | Z3 | Z4 | Z5 | Z6 | Z7 | Z8 | Z9 | Z10 | Z11 | Z12 | Z13 | Z14 |
| Polystyrene resin (Trade name: Polystyrene A-500, Mw: $5.89 \times 10^2$, made by Tosoh Corporation) | | | | | | | | | | | | | | 10 |
| Solvent | MEK | MEK | MEK | MEK | acetone | acetone | MIBK | DIBK | MEK | MEK | MEK | MEK | DIBK | MEK |

MEK: Methyl ethyl ketone
MiBK: Methyl isobutyl ketone
DiBK: Diisobutyl ketone

<Preparation of Developing Member>

[Preparation of Developing Member 1]

50 to 80 μL of coating material No. Z1 was dropped onto the surface of the electroconductive member D-1 using a syringe. The contact angle of the droplet of the coating material No. Z1 on the surface of the electroconductive member D-1 was measured 500 ms after dropping. The contact angle was measured using a contact angle meter DM-501 (made by Kyowa Interface Science Co., Ltd.) under an environment for measurement at a temperature of 23° C. and a relative humidity of 50% and under an atmospheric pressure at the ambient air flow rate of 0.1 m/sec or less. The results are shown in Table 5.

Next, the coating material No. Z1 was applied onto the surface of the electroconductive member D-1 by dipping according to the following procedure. First, the upper end of the mandrel was held with the longitudinal direction of the electroconductive member D-1 coincident with the vertical direction, and the electroconductive member D-1 was immersed in the coating material No. Z1, and then was lifted. In the application environment, the temperature was 23° C. and the relative humidity was 50% under an atmospheric pressure. The ambient air flow rate was 0.1 m/sec or less. The immersion time was 9 seconds. In the rate of lifting the electroconductive member from the coating material No. Z1, the initial rate was 30 mm/s and the final rate was 20 mm/s. The lifting rate was varied from the initial rate to the final rate linearly against the time. The electroconductive member Z-1 having a coating of the coating material No. Z1 formed thereon was placed in an oven, and was heated at a temperature of 120° C. for 80 minutes to dry the coating of the coating material No. Z1. Thus, a developing member 1 having electrically insulating domains on the surface was formed, the domains being independent from each other.

[Preparation of Developing Members 2 to 16]

A contact angle was measured in the same manner as for the developing member 1 except that the combination of the electroconductive member and the coating material for forming domains was varied as shown in Table 5. The results are shown in Table 5. Developing members 2 to 16 were prepared in the same manner as for developing member 1 except that the combination of the electroconductive member and the coating material for forming domains was varied as shown in Table 5. Developing members 2 to 16 having electrically insulating domains on their surfaces, the domains being independent from each other, were prepared in the same manner as for the developing member 1.

[Preparation of Developing Member 17]

The contact angle of the droplets of the coating material No. Z13 on the surface of the electroconductive member D-7 was measured in the same manner as for developing member 1. The results are shown in Table 5.

Next, a coating material for forming domains No. Z13 was applied onto the surface of the electroconductive member D-7 by spraying according to the following procedure. First, the electroconductive member D-7 was vertically disposed, and was rotated at 500 rpm. While a spray gun was being moved down at 5 mm/s, the coating material No. S7 was applied to the electroconductive member D-7 with spray gun. The application environment was under an atmospheric pressure at 23° C. and 50% RH. The distance between the spray gun and the surface of the electroconductive member D-7 was 20 mm. The mandrel having a coating of the coating material No. S7 formed thereon was placed in an oven, and was heated at temperature of 80° C. for 15 minutes. The mandrel was further heated in the oven at a temperature of 140° C. for 2 hours to prepare a developing member 17. A developing member 17 having electrically insulating domains on the surface thereof was prepared in the same manner as for developing member 1, the domains being independent from each other.

[Preparation of Developing Member 18]

A contact angle was measured in the same manner as for the developing member 1 except that the combination of the electroconductive member and the coating material for forming domains was varied as shown in Table 5. The results are shown in Table 5. A developing member 18 was prepared in the same manner as for developing member 1 except that the combination of the electroconductive member and the coating material for forming insulation was varied as shown in Table 5. A developing member 18 having electrically insulating domains on the surface thereof was prepared in the same manner as for the developing member 1, the domains being independent from each other.

[Preparation of Developing Member 19]

A contact angle was measured in the same manner as for the developing member 1 except that the combination of the electroconductive member and the coating material for forming insulation was varied as shown in Table 5. The results are shown in Table 5. A developing member 19 was prepared in the same manner as for developing member 1 except that the combination of the electroconductive member and the coating material for forming domains was varied as shown in Table 5. A developing member 19 having an electrically insulating homogenous film on the surface of the electroconductive member was prepared.

TABLE 5

| | Developing member No. | | | | | | | | | | | | | | | | | | |
|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 |
| Electroconductive member No. | D-1 | | | | | D-2 | D-1 | | D-3 | D-4 | D-5 | D-6 | D-1 | | | | D-7 | D-1 | D-8 |
| Coating material for forming domains No. | Z1 | Z2 | Z3 | Z4 | Z5 | Z6 | Z7 | Z8 | Z1 | | | | Z9 | Z10 | Z11 | Z12 | Z13 | Z14 | Z1 |
| Contact angle of droplet of coating material for forming domains on surface of electroconductive member (°) | 33 | 22 | 28 | 38 | 28 | 15 | 35 | 39 | 41 | 33 | 33 | 33 | 34 | 33 | 33 | 33 | 48 | 33 | 9 |

[Preparation of Developing Member 20]

Using a phase separation phenomenon of the conductive material and the insulating material contained in the coating solution, a developing member having domains in the electroconductive layer was prepared by the following procedure.

The materials in the compounding proportion shown in Table 6 were stirred and dispersed with a ball mill to prepare the coating material M for forming an electroconductive layer and domains at the same time.

Next, the mandrel having the conductive silicone rubber layer formed thereon was vertically disposed, and was rotated at 1500 rpm. While a spray gun was being moved down at 30 mm/s, the coating material M was applied with the spray gun. The application environment was under an atmospheric pressure at a temperature of 23° C. and a humidity of 50% RH. The distance between the spray gun and the surface of the conductive silicone rubber layer was 90 mm. The coated product having a coating of the coating material M was placed in an oven, and was heated at a temperature of 80° C. for 15 minutes. The product was further heated in the oven at a temperature of 140° C. for 2 hours to cure the coating. A conductive urethane resin layer having a film thickness of 15.0 μm was formed on the conductive silicone rubber layer. A developing member 20 having electrically insulating polyester domains on the surface and in the matrix of the conductive urethane resin layer was prepared, the domains being independent from each other.

TABLE 6

| | Material | Parts by mass |
|---|---|---|
| Coating material M | Ether polyol (Trade name: Adeka polyether PR-3007, made by Adeka Corporation) | 70 |
| | Insulating polyester resin (Trade name: Vylon 200, made by TOYOBO CO., LTD.) | 20 |
| | Isocyanate (Trade name: Millionate MR-400, made by Tosoh Corporation) | 10 |
| | Carbon black (Trade name: TOKABLACK#7360SB; made by Tokai Carbon Co., Ltd.) | 10 |
| | MEK | 300 |

* Numerals shown under the column "parts by mass" in the table each shows the mass in terms of the solid content (parts by mass) of the material.

[Preparation of Developing Member 21]

Insulating particles were compounded in a conductive rubber material, and a developing member having domains (particles) in an electroconductive layer was prepared by the following procedure.

A mandrel was prepared in the same manner as in Production Example 1. The materials shown in Table 7 below were kneaded to prepare an unvulcanized rubber composition. Next, a crosshead extruder having a mechanism to feed a substrate and a mechanism to discharge an unvulcanized rubber composition was provided. A die having an inner diameter of 10.1 mm was attached to the crosshead. The temperature of the extruder and that of the crosshead were adjusted at 30° C. and the transfer rate of the substrate was adjusted at 60 mm/sec. On this condition, the unvulcanized rubber composition was fed from the extruder, and was applied onto the outer periphery of the substrate in the crosshead. The unvulcanized rubber composition was applied as an elastic layer to prepare an unvulcanized rubber roller. Next, the unvulcanized rubber roller was placed into a hot air vulcanization furnace at 170° C., and was heated for 15 minutes. Subsequently, after the rubber was vulcanized, the rubber was polished with a rotary polisher (trade name: LEO-600-F4 L-BME, made by Minakuchi Machinery Works Ltd.) using a GC80 grinding wheel to produce a developing member 21 including an electroconductive layer (thickness: 2 mm) on the outer periphery of the mandrel and insulating resin particles exposed from the surface thereof.

TABLE 7

| | Material | Parts by mass |
|---|---|---|
| Materials for extrusion | Millable silicone rubber material (Trade name: TSE270-4U, made by Momentive Performance Materials Japan LLC) | 100 |
| | Insulating resin particle (Trade name: Mipelon MX220, made by Mitsui Chemicals, Inc.) | 15 |
| | Carbon black (Trade name: TOKABLACK#7360SB; made by Tokai Carbon Co., Ltd.) | 10 |
| | Curing agent (Trade name: TC-8; made by Momentive Performance Materials Japan LLC) | 0.5 |

* Numerals shown under the column "parts by mass" in the table each shows the mass in terms of the solid content (parts by mass) of the material.

<Evaluation of Developing Member>

<<Evaluation 1: Area Solidity S/H of Domain>>

The developing member 1 was fixed to a stage such that the longitudinal direction of the developing member was disposed along the vertical direction of the stage, and was observed at a magnification of 100× from the surface normal direction using a video microscope (trade name: DIGITAL MICROSCOPE VHX-5000, made by Keyence Corporation) and a zoom lens (lens used, trade name: Swing Head Zoom Lens VH-ZST). At this time, by use of the ring light attached to the zoom lens as light for observation, only domains can be darkened in an observed image of the surface of the developing member.

A rectangle in the center of the obtained image measuring 3 mm in the longitudinal direction and 1 mm in the circumferential direction of the developing member 1 was defined as an observed region. Using image analysis software "Image J ver. 1.45" (developed by Wayne Rasband National Institutes of Health, NIH), the background luminance distribution was removed at a flattening radius of 40 pixels in a Subtract Background menu, and the domains were binarized at a luminance threshold of 128. Only the domains completely contained in the observed region were observed.

In the obtained binarized image, the area solidity S/H was measured in an Analyze Particle menu of the image analysis software. The Solidity output from the image analysis software corresponds to the area solidity S/H.

The developing member was observed and measured at any 50 domains thereof to determine the percentage of the number of domains where the area solidity S/H of the domains was 0.05 or more and 0.80 or less, and the arithmetic average of the area solidity S/H.

<<Evaluation 2: Area S of Domains>>

The area S of the domain was determined. Only the domains for observation for the measurement of the area solidity S/H were measured as the target. The percentage of the number of domains where the area S of the domain was 300 $\mu m^2$ or more and 100000 $\mu m^2$ or less, and the arithmetic average of the area S were determined.

<<Evaluation 3: Horizontal Feret's Diameter of Domains>>

The horizontal Feret's diameter of the domain was determined. Only the domains for observation for the measurement of the area solidity S/H were measured as the target. A rectangle circumscribing the domain was drawn that one side of the rectangle was parallel to the longitudinal direction of the developing member, and the length of the side was defined as a horizontal Feret's diameter R'. The arithmetic average of the horizontal Feret's diameter was determined.

<<Evaluation 4: Coating Rate by Domains>>

The coating rate by domains was determined. Using the observation image of 50 points obtained in the measurement of the area solidity S/H, the sum of the areas of the domains present in the region in the observation field was defined as S', and the proportion of the sum S' in the observation field was defined as a coating rate by domains A'. The same measurement was performed at the 50 points of the observation image above, and the arithmetic average of the obtained values was defined as a coating rate A.

<<Evaluation 5: Thickness of Domain>>

The thickness of domain was determined. A cross-section of the developing member 1 was cut out with a razor such that the blade was placed vertical to the surface of the developing member 1. This cross-section is observed with a scanning electron microscope (trade name: JSM-7800 FPRIME Schottky field emission scanning electron microscope, made by JEOL, Ltd.). The maximum value of the thickness of the domain in the normal direction on the developing member surface is defined as L'. This measurement was performed at any 20 points of the developing member surface, and the arithmetic average of the obtained values was defined as a thickness L of the domain.

[Measurement of Developing Members 1 to 21]

The area solidity S/H, the area S, the horizontal Feret's diameter, the coating rate, and the thickness of the domain were determined by the evaluation methods above. The results are shown in Tables 8 to 10.

In the developing members 18, 20, and 21, the percentage of the number of domains having a value of S/H within the range of 0.05 to 0.80 was 0%.

In the developing member 19, independent domains were not present, rather were present as a uniform film. For this reason, the percentage of the number of domains having a value of S/H within the range of 0.05 to 0.80 was 0%.

TABLE 8

| | | Developing member No. | | | | | | | |
|---|---|---|---|---|---|---|---|---|---|
| | | 1 | 2 | 3 | 4 | 5 | 6 | 7 | 8 |
| Evaluation 1 | Percentage (%) of number of domains where 0.05 ≤ S/H ≤ 0.08 | 78 | 21 | 43 | 63 | 77 | 65 | 66 | 69 |
| | Average of S/H | 0.51 | 0.79 | 0.63 | 0.22 | 0.57 | 0.61 | 0.41 | 0.35 |
| | Percentage (%) of number of domains having area within range of 300 $\mu m^2$ or more and 100,000 $\mu m^2$ or less | 85 | 81 | 88 | 80 | 65 | 30 | 59 | 31 |
| Evaluation 2 | Average of area S ($\mu m^2$) | 17,815 | 5,895 | 10,659 | 11,624 | 4,567 | 2,442 | 43,668 | 80,563 |
| Evaluation 3 | Horizontal Feret's diameter (μm) | 351 | 222 | 315 | 405 | 101 | 103 | 842 | 745 |
| Evaluation 4 | Coating rate (%) | 25.0 | 28.3 | 26.5 | 30.4 | 22.3 | 26.5 | 26.5 | 30.1 |
| Evaluation 5 | Thickness (μm) | 1.0 | 1.3 | 1.4 | 2.3 | 0.8 | 0.9 | 3.0 | 2.6 |

TABLE 9

| | | Developing member No. | | | | | | | | |
|---|---|---|---|---|---|---|---|---|---|---|
| | | 9 | 10 | 11 | 12 | 13 | 14 | 15 | 16 | 17 |
| Evaluation 1 | Percentage (%) of number of domains where 0.05 ≤ S/H ≤ 0.08 | 69 | 75 | 71 | 73 | 72 | 71 | 73 | 75 | 33 |
| | Average of S/H | 0.51 | 0.48 | 0.32 | 0.43 | 0.49 | 0.51 | 0.57 | 0.58 | 0.05 |
| | Percentage (%) of number of domains having area within range of | 86 | 90 | 88 | 84 | 83 | 84 | 89 | 90 | 84 |

TABLE 9-continued

| | | Developing member No. | | | | | | | | |
|---|---|---|---|---|---|---|---|---|---|---|
| | | 9 | 10 | 11 | 12 | 13 | 14 | 15 | 16 | 17 |
| | 300 $\mu m^2$ or more and 100,000 $\mu m^2$ or less | | | | | | | | | |
| Evaluation 2 | Average of area S ($\mu m^2$) | 3,558 | 5,640 | 22,952 | 52,842 | 20,118 | 19,608 | 8,674 | 7,737 | 20,350 |
| Evaluation 3 | Horizontal Feret's diameter (μm) | 57 | 105 | 1980 | 2451 | 307 | 455 | 413 | 295 | 508 |
| Evaluation 4 | Coating rate (%) | 33.7 | 27.5 | 28.9 | 33.5 | 62.3 | 50.0 | 15.0 | 12.3 | 18.5 |
| Evaluation 5 | Thickness (μm) | 1.5 | 1.0 | 2.2 | 1.9 | 6.7 | 5.4 | 0.9 | 0.5 | 3.1 |

TABLE 10

| | Developing member No. | 18 | 19 | 20 | 21 |
|---|---|---|---|---|---|
| Evaluation 1 | Percentage (%) of number of domains where 0.05 ≤ S/H ≤ 0.08 | 0 | 0 | 0 | 0 |
| | Average of S/H | 0.93 | — | 0.92 | 0.99 |
| | Percentage (%) of number of domains having an area within range of 300 $\mu m^2$ or more and 100,000 $\mu m^2$ or less | 90 | 0 | 51 | 35 |
| Evaluation 2 | Average of area S ($\mu m^2$) | 2,318 | — | 3,481 | 4,948 |
| Evaluation 3 | Horizontal Feret's diameter (μm) | 51 | — | 72 | 30 |
| Evaluation 4 | Coating rate (%) | 45.3 | 100.0 | 50.9 | 30.0 |
| Evaluation 5 | Thickness (μm) | 2.3 | 1.1 | 13.0 | 25.0 |

<<Evaluation 6: Evaluation of Domains>>

[Domains Having Different S/H]

In each of the domains having an S/H within or out of the range of 0.05 to 0.80, the charge retention and the amount of the toner applied were evaluated under a high temperature and high humidity environment.

First, eight domains having different values of the area solidity S/H were selected from each of the developing members 1, 2, 4, 17 and 18. The respective domains are referred to as domain No. 1 to 8. The area solidity S/H, the area, and the horizontal Feret's diameter of each domain are shown in Table 11.

[Evaluation of Domain No. 1]

[Evaluation 6-1: Evaluation of Charging of Domains]

A process cartridge for magenta for an electrophotographic image forming apparatus (trade name: Color Laser Jet Pro M452 dw, made by Hewlett-Packard Company) including the developing member 1 was prepared with the toner feed roller removed, and the image forming apparatus was left to stand under an environment at a temperature of 30° C. and a humidity of 80% RH for 24 hours. Next, a solid black image was continuously output onto 20 sheets of A4-sized paper at a rate of 28 sheets/min under the same environment as above to charge the domain No. 1 on the developing member 1.

Next, the toner was blown off by air, and the development member 1 was set in an Electrostatic Force Microscope (made by Trek Japan, K.K.) installed in the same environment as above to measure the surface potential of the domain No. 1 on the surface of the developing member 1. The measurement was performed in a region of a 1 mm square at a pitch of 2 μm such that the distance between the probe distal end of the cantilever and the surface of the domain was 10 μm. The arithmetic average of the surface potentials of the domains obtained was defined as a surface potential of the domain No. 1. Main measurement was started after 5 minutes from the completion of the charging previously performed.

The results are shown in Table 11.

[Evaluation 6-2: Evaluation of Amount of Toner Applied in Domains]

A toner was removed from the process cartridge for magenta for an electrophotographic image forming apparatus (trade name: Color Laser Jet Pro M452 dw, made by Hewlett-Packard Company), and 800 ml of the toner was placed into a 1000 mL measuring cylinder (total height: 285 mm, inner diameter: Φ70 mm) made of polypropylene. The developing member 1 was placed into the measuring cylinder, and then was lifted up therefrom to apply the toner to the domain No. 1.

Next, the amount of the toner applied near the domains was measured. The amount of the toner was measured by a laser microscope (trade name: VK-8700, made by Keyence Corporation) using an object lens of 50×. The domain No. 1 was measured immediately from above with the laser microscope to obtain height information. The height information was obtained at a pitch of 283 nm for measurement. Subsequently, the toner was blown off by compressed air, and the height information of the same region as above was obtained. By subtracting these pieces of height information, the height information of the toner applied to the domain No. 1 can be obtained. In the examination according to the present aspect, the arithmetic average of the height information of the toner applied onto the domains was defined as the amount of the toner applied to the domain No. 1. The average of the toner height is shown in Table 11.

[Evaluation of Domains No. 2 to 8]

The domains No. 2 to 8 were evaluated in the same manner as for the domain No. 1. The results are shown in Table 11.

TABLE 11

| | Domain No. | | | | | | | |
|---|---|---|---|---|---|---|---|---|
| | 1 | 2 | 3 | 4 | 5 | 6 | 7 | 8 |
| Area solidity S/H | 0.39 | 0.50 | 0.61 | 0.02 | 0.05 | 0.23 | 0.80 | 0.91 |
| Area ($\mu m^2$) | 15,388 | 16,393 | 18,832 | 8,514 | 13,414 | 10,394 | 7,937 | 4,024 |
| Horizontal Feret's diameter (μm) | 333 | 350 | 370 | 538 | 567 | 415 | 289 | 79 |
| Evaluation 6-1 Potential (V) | −15.3 | −16.5 | −12.7 | −3.8 | −11.7 | −13.1 | −11.4 | −4.5 |
| Evaluation 6-2 Toner height (μm) | 30.8 | 36.7 | 29.5 | 2.5 | 18.5 | 25.8 | 20.5 | 5.0 |

From the results of evaluations 6-1 and 6-2, it is found that if the domains have a value of S/H of 0.05 or more and 0.80 or less, the amount of the toner applied is significantly increased in the region of the domain including the convex envelope region.

<Evaluation 7: Image Evaluation>

[Evaluation 7-1: Evaluation of Charging of Developing Member at 30° C./80% RH]

First, to reduce the torque, a toner feed roller was removed from the process cartridge for magenta for an electrophotographic image forming apparatus (trade name: Color LaserJet Pro M452 dw, made by Hewlett-Packard Company). Thereby, the torque is reduced while the amount of the toner fed to the developing member is reduced. Next, the developing member 1 was mounted as a developing member for this process cartridge, and was left to stand under an environment at a temperature of 30° C. and a humidity of 80% RH for 24 hours. Next, a solid black image was continuously output onto 20 sheets of A4-sized paper at a rate of 28 sheets/min under the same environment as above, and the developing member 1 was removed. The toner was blown off by the air, and the surface potential of the developing member 1 was measured. At this time, the measured region was the region between the electrophotographic photosensitive member and the developer amount regulating member when the output operation was stopped. In the measuring method, the mandrel of the developing member 1 was grounded, and the potential of the surface of the developing member 1 was measured at a point 6 mm away from the surface of the developing member with a surface electrometer (trade name: MODEL344, made by Trek Inc.) connected to a surface potential probe (trade name: MODEL 6000B-8).

[Evaluation 7-2: Evaluation of Amount of Toner Transferred by Developing Member at 30° C./80% RH]

Next, a solid black image was continuously output onto 10 sheets of A4-sized paper at a rate of 28 sheets/min under the same environment as above. The output operation was stopped while one sheet of a solid black image was being output. The developing member 1 was removed to measure the amount of the toner applied to the developing member 1 (the amount of the toner transferred). At this time, the measured region was a region between the electrophotographic photosensitive member contact region and the toner regulating member contact region when the output operation was stopped. In the measuring method, the toner was sucked using a suction nozzle having an opening having a diameter of 5 mm, and the mass of the sucked toner and the area of the sucked region were measured to determine the amount of the toner transferred ($mg/cm^2$), which was evaluated according to the following criteria:

Rank A: 1.20 $mg/cm^2$ or more.

Rank B: 0.80 $mg/cm^2$ or more and less than 1.20 $mg/cm^2$.

Rank C: 0.40 $mg/cm^2$ or more and less than 0.80 $mg/cm^2$.

Rank D: less than 0.40 $mg/cm^2$.

[Evaluation 7-3: Evaluation of Difference in Image Density of Developing Member at 30° C./80% RH]

Next, a black solid image was output onto one sheet of A4-sized paper at a rate of 28 sheets/min. The image density of the resulting solid image was measured using a spectrodensitometer (trade name: 508, made by Xrite, Inc.). The difference in concentration between the distal end of the image and the proximal end to evaluate according to the following criteria:

Rank A: less than 0.05.

Rank B: 0.05 or more and less than 0.10.

Rank C: 0.10 or more and less than 0.20.

Rank D: 0.20 or more.

[Evaluation 7-4: Evaluation of Charging of Developing Member at Temperature of 15° C./10% RH]

The electrophotographic image forming apparatus (trade name: Color Laser JetPro M452 dw, made by Hewlett-Packard Company) and the process cartridge for magenta with the toner feed roller removed therefrom, which were used in the evaluations above, were left to stand under an environment at a temperature of 15° C. and a humidity of 10% RH for 24 hours. Next, a solid white image was continuously output onto 50 sheets of A4-sized paper at a rate of 28 sheets/min under the same environment as above, and the output operation was stopped while the solid white image was output onto one sheet. The developing member 1 was removed, and the toner was blown off by the air. The surface potential of the developing member 1 was then measured. At this time, the measured region was the region between the electrophotographic photosensitive member and the developer amount regulating member when the output operation was stopped. In the measuring method, the mandrel of the developing member 1 was grounded, and the potential of the surface of the developing member 1 was measured at a point 6 mm away from the surface of the developing member with a surface electrometer (trade name: MODEL344, made by Trek Inc.) connected to a surface potential probe (trade name: MODEL 6000B-8). The results were evaluated according to the following criteria:

Rank A: less than −15 V

Rank B: −15 V or more and less than −25 V.

Rank C: −25 V or more and less than −35 V.

Rank D: −35 V or more.

[Evaluation 7-5: Evaluation of Image Density Stability of Developing Member at Temperature of 15° C./10% RH]

Next, a 25% halftone image of solid black was continuously output onto one sheet of A4-sized paper at a rate of 28 sheets/min, a solid white image was continuously output onto 48 sheets, and then a 25% halftone image of solid black was continuously output onto one sheet in this order. The concentrations of the first and the 50th sheets of the halftone image were measured using a spectrodensitometer (trade name: 508, made by Xrite, Inc.) to determine the difference in concentration between the first sheet and the 50th sheet. The difference in image density was evaluated according to the following criteria:

Rank A: less than 0.05.

Rank B: 0.05 or more and less than 0.10.

Rank C: 0.10 or more and less than 0.20.

Rank D: 0.20 or more.

The developing members 1 to 17 according to Examples and the developing members 18 to 21 according to Comparative Example were fed to the evaluations 7-1 to 7-4. The results are shown in Tables 12 to 14.

TABLE 12

| | | Example | | | | | | | |
|---|---|---|---|---|---|---|---|---|---|
| | | 1 | 2 | 3 | 4 | 5 | 6 | 7 | 8 |
| | Developing member No. | 1 | 2 | 3 | 4 | 5 | 6 | 7 | 8 |
| Evaluation 7-1 | Surface potential at H/H (V) | −8.8 | −4.7 | −6.5 | −7.8 | −6.8 | −4.2 | −8.5 | −6.8 |
| Evaluation 7-2 | Amount of toner transferred at H/H (mg/cm$^2$) | 1.35 | 0.79 | 1.05 | 1.17 | 1.07 | 0.75 | 1.25 | 0.99 |
| | Evaluation rank of amount of toner transferred at H/H | A | C | B | B | A | B | A | B |
| Evaluation 7-3 | Evaluation rank of image at H/H | A | B | B | B | B | B | B | B |
| Evaluation 7-4 | Surface potential at L/L (V) | −10.5 | −13.5 | −12.4 | −11.7 | −10.8 | −9.7 | −18.5 | −25.1 |
| | Evaluation rank of surface potential at L/L | A | B | B | A | A | A | B | C |
| Evaluation 7-5 | Evaluation rank of image at L/L | A | B | A | A | A | A | B | B |

TABLE 13

| | | Example | | | | | | | | |
|---|---|---|---|---|---|---|---|---|---|---|
| | | 9 | 10 | 11 | 12 | 13 | 14 | 15 | 16 | 17 |
| | Developing member No. | 9 | 10 | 11 | 12 | 13 | 14 | 15 | 16 | 17 |
| Evaluation 7-1 | Surface potential at H/H (V) | −4.2 | −6.3 | −8.3 | −8.1 | −10.5 | −9.7 | −4.1 | −3.9 | −4.1 |
| Evaluation 7-2 | Amount of toner transferred at H/H (mg/cm$^2$) | 0.71 | 1.03 | 1.19 | 1.18 | 1.52 | 1.45 | 0.55 | 0.47 | 0.80 |
| | Evaluation rank of amount of toner transferred at H/H | C | B | B | B | A | A | C | C | C |
| Evaluation 7-3 | Evaluation rank of image at H/H | B | B | B | B | A | A | B | B | B |
| Evaluation 7-4 | Surface potential at L/L (V) | −18.6 | −15.2 | −15.4 | −25.6 | −30.1 | −26.4 | −8.5 | −6.3 | −11.5 |
| | Evaluation rank of surface potential at L/L | B | B | B | C | C | C | A | A | A |
| Evaluation 7-5 | Evaluation rank of image at L/L | B | B | B | B | C | B | A | A | A |

TABLE 14

| | | Comparative Example | | | |
|---|---|---|---|---|---|
| | | 1 | 2 | 3 | 4 |
| | Developing member No. | 18 | 19 | 20 | 21 |
| Evaluation 7-1 | Surface potential at H/H (V) | −2.1 | −3.5 | −2.5 | 21.0 |
| Evaluation 7-2 | Amount of toner transferred at H/H (mg/cm$^2$) | 0.23 | 0.11 | 0.39 | 0.40 |
| | Evaluation rank of amount of toner transferred at H/H | D | D | C | C |
| Evaluation 7-3 | Evaluation rank of image at H/H | D | D | C | C |
| Evaluation 7-4 | Surface potential at L/L (V) | −31.7 | −42.8 | −41.3 | −41.0 |
| | Evaluation rank of surface potential at L/L | C | D | D | D |
| Evaluation 7-5 | Evaluation rank of image at L/L | C | D | D | D |

In Examples 1 to 17, it was verified that domains independent from each other were present on the outer surface of the developing member. At the same time, domains having an S/H within the range represented by $0.05 \leq S/H \leq 0.80$ were verified where when the domains were orthographically projected onto the surface of the electroconductive layer, the area of the projected image of each domain was defined as S and the area of the convex envelope of the projected image of each domain was defined as H.

From the results of Examples 1 to 17 and Comparative Examples 1 to 4, it is found that if the domains have a value of S/H of 0.05 or more and 0.80 or less, the developing member has a high toner transfer ability under both of a low temperature and low humidity environment and a high temperature and high humidity environment, and high-quality electrophotographic images can be formed without excessive charging of the developing member.

From the results of Examples 1 to 4 and 17, it is found that if the number proportion of the domains having a value of S/H of 0.05 or more and 0.80 or less is 80% or more, the developing member has a high toner transfer ability under both of a low temperature and low humidity environment and a high temperature and high humidity environment, and high-quality electrophotographic images can be formed more favorably without excessive charging of the developing member.

From the results of Example 1 and Examples 5 to 8, if the area S of domains is 300 to 100000 μm$^2$, the developing member has a high toner transfer ability under both of a low temperature and low humidity environment and a high temperature and high humidity environment, and high-quality electrophotographic images can be formed more favorably without excessive charging.

From the results of Example 1 and Examples 9 to 12, it is found that the arithmetic average of the horizontal Feret's diameter of domains is 100 to 2000 μm, the developing member has a high toner transfer ability under both of a low temperature and low humidity environment and a high temperature and high humidity environment, and high-quality electrophotographic images can be formed more favorably without excessive charging.

Furthermore, from the results of Example 1 and Examples 13 to 16, it is found that the sum of the areas S of domains located in a rectangular region having a side of 3.0 mm in the longitudinal direction and a side of 1.0 mm in the circumferential direction on the outer surface of developing member is 15 to 50% relative to the area of the region, the developing member has a high toner transfer ability under both of a low temperature and low humidity environment and a high temperature and high humidity environment, and high-quality electrophotographic images can be formed more favorably without excessive charging.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-032436, filed Feb. 26, 2018, which is hereby incorporated by reference herein in its entirety.

What is claimed is:

1. An electrophotographic developing member, comprising:

a substrate;

an electroconductive layer on the substrate; and electrically insulating domains on an outer surface of the electroconductive layer, the domains being independent from each other, wherein the developing member has an outer surface including a surface of the electroconductive layer that is not coated with the domains, and surfaces of the domains, and when observing the outer surface of the developing member with a microscope, at least one of the domains satisfies $0.05 \leq S/H \leq 0.80$ where S is the respective areas of the observed domains and H is the respective areas of convex envelopes of the observed domains.

2. The developing member according to claim 1, wherein at least 20% of the domains satisfy $0.05 \leq S/H \leq 0.80$.

3. The developing member according to claim 2, wherein at least 80% of the domains have an area S in the range of 300 to 100000 $\mu m^2$.

4. The developing member according to claim 2, wherein an arithmetic average of horizontal Feret's diameters of the domains that are parallel to a longitudinal direction of the developing member is 100 to 2000 μm.

5. The developing member according to claim 2, wherein a sum of the areas S of the domains located in a rectangular region on the outer surface of the developing member having a side of 3.0 mm in a longitudinal direction of the developing member and a side of 1.0 mm in a circumferential direction of the developing member is 15 to 50% relative to the area of the rectangular region.

6. The developing member according to claim 1, wherein the domains have a volume resistivity of $1.0 \times 10^{13}$ to $1.0 \times 10^{18}$ Ω·cm.

7. The developing member according to claim 1, wherein the domains have a volume resistivity of $1.0 \times 10^{14}$ to $1.0 \times 10^{17}$ Ω·cm.

8. The developing member according to claim 1, wherein the electroconductive layer has a volume resistivity of $1.0 \times 10^{1}$ to $1.0 \times 10^{12}$ Ω·cm.

9. The developing member according to claim 1, wherein the electroconductive layer has a volume resistivity of $1.0 \times 10^{1}$ to $1.0 \times 10^{10}$ Ω·cm.

10. The developing member according to claim 1, wherein the electroconductive layer comprises polyurethane resin.

11. The developing member according to claim 1, wherein the electroconductive layer contains particles forming protrusions on the outer surface of the electrophotographic member.

12. The developing member according to claim 1, wherein the domains comprises resin.

13. The developing member according to claim 12, wherein the resin is at least one member selected from the group consisting of acrylic resin, polyolefin resin, epoxy resin and polyester resin.

14. The developing member according to claim 1, wherein the domains are formed by wet coating a material for forming the domains on the outer surface of the electroconductive layer.

15. The developing member according to claim 1, wherein the domains are formed by wet coating and repelling a material forming the domains on the outer surface of the electroconductive layer.

16. The developing member according to claim 15, wherein the material has a contact angle of 10 to 90° with respect to the outer surface of the electroconductive layer.

17. An electrophotographic process cartridge configured to be detachably mountable on an electrophotographic image forming apparatus, the electrophotographic process cartridge comprising:

a toner container containing toner; and a developing unit that transfers the toner, the developing unit including a developing member comprising a substrate, an electroconductive layer and electrically insulating domains on an outer surface of the electroconductive layer, the domains being independent from each other, wherein the developing member has an outer surface including a surface of the electroconductive layer that is not coated with the domains, and surfaces of the domains, and when observing the outer surface of the developing member with a microscope, at least one of the domains satisfies $0.05 \leq S/H \leq 0.80$ where S is the respective areas of the observed domains and H is the respective areas of convex envelopes of the observed domains.

18. An electrophotographic image forming apparatus, comprising:

an electrophotographic photosensitive member;

a charging unit disposed to be capable of charging the electrophotographic photosensitive member; and a developing unit that feeds a toner to the electrophotographic photosensitive member, the developing unit including a developing member comprising a substrate, an electroconductive layer and electrically insulating domains on an outer surface of the electroconductive layer, the domains being independent from each other, wherein the developing member has an outer surface including a surface of the electroconductive layer that is not coated with the domains, and surfaces of the domains, and when observing the outer surface of the developing member with a microscope, at least one of the domains satisfies $0.05 \leq S/H \leq 0.80$ where S is the respective areas of the observed domains and H is the respective areas of convex envelopes of the observed domains.

* * * * *